US009140057B2

(12) United States Patent
Cheng

(10) Patent No.: US 9,140,057 B2
(45) Date of Patent: Sep. 22, 2015

(54) WINDOW COVERING

(71) Applicant: Li-Ming Cheng, Kaohsiung (TW)

(72) Inventor: Li-Ming Cheng, Kaohsiung (TW)

( * ) Notice: Subject to any disclaimer, the term of this patent is extended or adjusted under 35 U.S.C. 154(b) by 0 days.

(21) Appl. No.: 13/777,370

(22) Filed: Feb. 26, 2013

(65) Prior Publication Data

US 2014/0048220 A1 Feb. 20, 2014

(30) Foreign Application Priority Data

Aug. 20, 2012 (CN) ..... 2012 2 0414312

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/24*** | (2006.01) |
| ***E06B 9/262*** | (2006.01) |
| *E06B 9/322* | (2006.01) |

(52) U.S. Cl.

CPC . *E06B 9/24* (2013.01); *E06B 9/262* (2013.01); *E06B 2009/2625* (2013.01); *E06B 2009/3222* (2013.01)

(58) Field of Classification Search

CPC ..... E06B 9/322; E06B 9/325; E06B 9/521; E06B 9/52; E06B 9/262; E06B 2009/2625; E06B 2009/2627; E06B 2009/3222

USPC ..... 160/167 R, 167 V, 170, 171, 368.1, 160/84.01, 84.02, 84.04, 84.05

See application file for complete search history.

(56) References Cited

U.S. PATENT DOCUMENTS

| | | | | |
|---|---|---|---|---|
| 7,373,965 | B2 | 5/2008 | Cheng | |
| 7,575,036 | B2 * | 8/2009 | Cheng | 160/170 |
| 2006/0196612 | A1 * | 9/2006 | Strand et al. | 160/84.05 |
| 2006/0237144 | A1 * | 10/2006 | Cheng | 160/84.04 |
| 2008/0099159 | A1 * | 5/2008 | Nien | 160/170 |

* cited by examiner

*Primary Examiner* — Katherine Mitchell
*Assistant Examiner* — Jeremy Ramsey
(74) *Attorney, Agent, or Firm* — Muncy, Geissler, Olds & Lowe, P.C.

(57) ABSTRACT

A window covering comprises an upper rail, a window shade, a lower rail, a press member located in the lower rail and extended therefrom, a first press assembly and a second press assembly located in the lower rail and spaced from each other to contact the press member, and a cord winding assembly located in the lower rail to connect to the first and second press assemblies. A first cord and a second cord run through the window shade to fasten to the cord winding assembly. A user can depress the press member and push or pull the lower rail upwards or downwards, so that the window shade can be retracted upwards or extended downwards through the first and second cords. Moreover, the first and second cords are held inside the lower rail, hence accident caused by the exposed cords can be prevented.

5 Claims, 10 Drawing Sheets

WINDOW COVERING

FIELD OF THE INVENTION

The present invention relates to a window covering and particularly to a window covering including concealed cords.

BACKGROUND OF THE INVENTION

There are different types of window coverings on the market, such as Venetian shades, pleated shades, Roman shades and the like. They are mainly installed on doors and windows in the houses to block sunshine and provide decoration according to consumers' requirements.

A conventional window covering can be generally retracted or extended by lifting a cord upwards or downwards. For instance, U.S. Pat. No. 7,373,965 discloses a window covering 10 as shown in FIGS. 1 and 2 that mainly includes a seat 11, a control switch 12 and a cord assembly 13. The cord assembly 13 has cords 131 that together run through an aperture (not shown in the drawings) at the bottom of the seat 11, a hole on an anchor member (also not shown in the drawings) of the control switch 12, and an opening (not shown in the drawings) of a depressing member 121 of the control switch 12 such that the cords 131 can be gathered at a lower side of the seat 11 and controlled by the control switch 12. When retracting the window covering 10 is desired, user presses the depressing member 121 of the control switch 12 with one hand and pulls the lower ends of the cords 131 downwards with the other hand to finish the retraction operation of the window covering 10 at one time (referring to FIG. 3). But after the window covering 10 has been retracted, the cords 131 are exposed outside without being concealed, so that they could be easily treated by children as playthings and result in hazardous accidents due to strangling.

SUMMARY OF THE INVENTION

The primary object of the present invention is to solve the environmental safety problem of the conventional window coverings that have the cords exposed during retraction by providing a window covering with cords wound and held in a lower rail.

To achieve the foregoing object, the window covering of the invention includes an upper rail, a window shade which is located below the upper rail and has a first cord and a second cord, a lower rail which is located under the window shade and includes a slot at one side in the middle thereof, a press member located in the lower rail and extended outwards through the slot, a first press assembly and a second press assembly located inside the lower rail and spaced from each other in contact with the press member, and a cord winding assembly located in the lower rail corresponding to the slot and connected to the first press assembly and second press assembly. The first cord and second cord have respectively one end threading through the lower end of the upper rail and fastened thereon, and the other end threading through the window shade, the interior of the lower rail, and the first and second press assemblies in this order to connect to the cord winding assembly for fastening.

By means of the structure set forth above, compared with the conventional techniques, the invention provides many advantages, notably:

With the first cord and second cord threading through the upper rail, the window shade and the interior of the lower rail to connect to the cord winding assembly, they can be concealed inside the cord winding assembly of the lower rail without exposing outside during retraction of the window covering to prevent hazardous accident from occurring caused by entangling the children.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
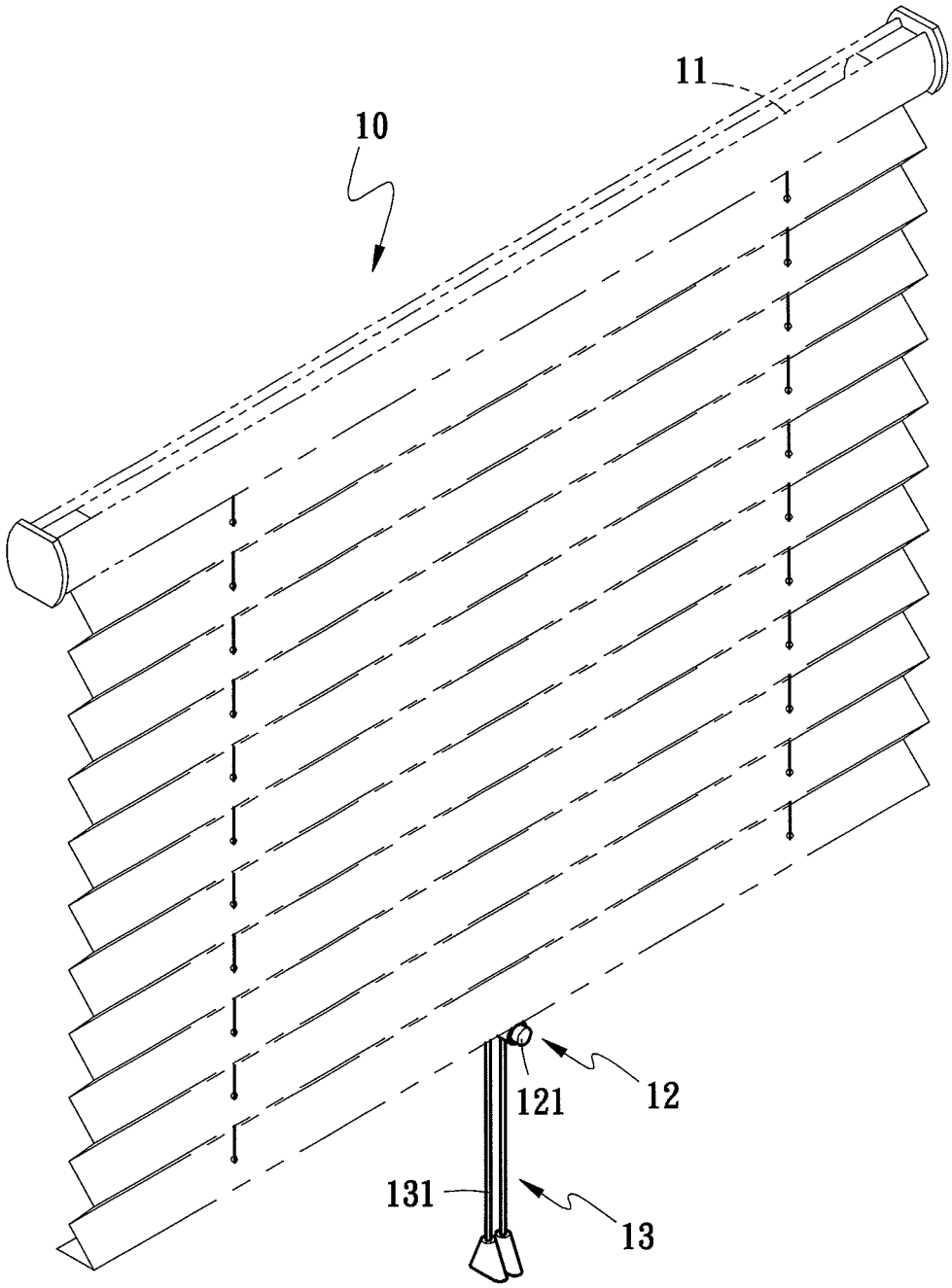
Fig . 1 PRIOR ART
FIG. 1 is a perspective view of a conventional window covering.
Figure 2:
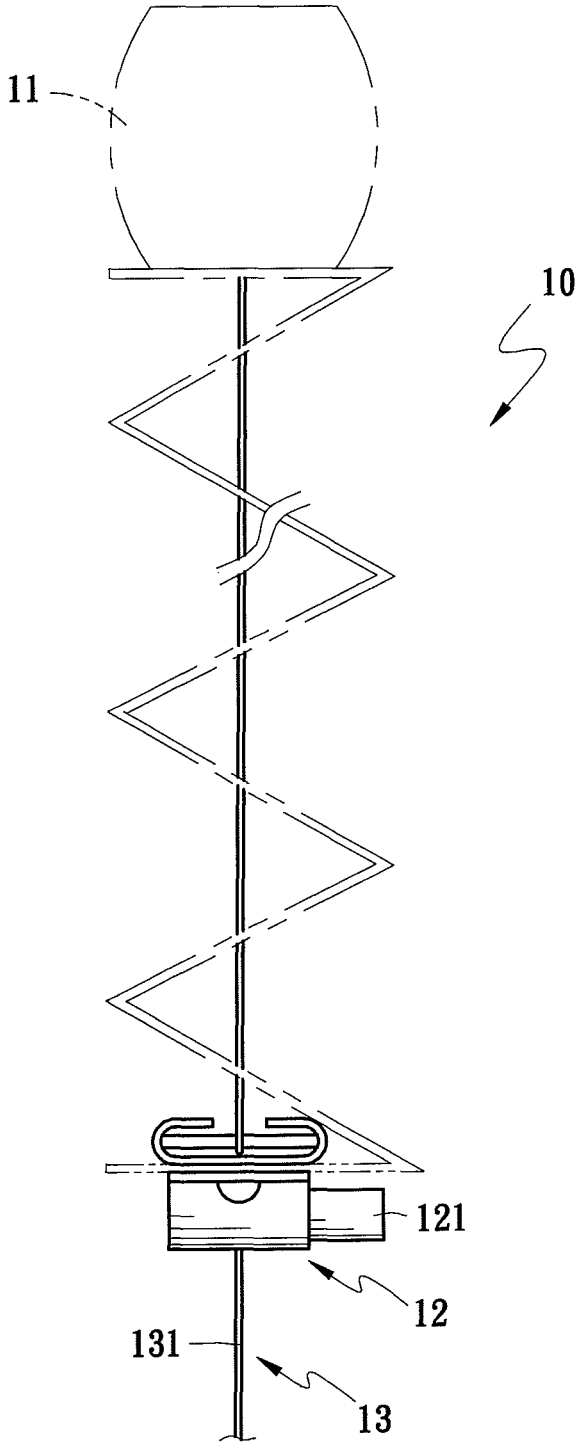
Fig . 2 PRIOR ART
FIG. 2 is a side view of a conventional window covering.
Figure 3:
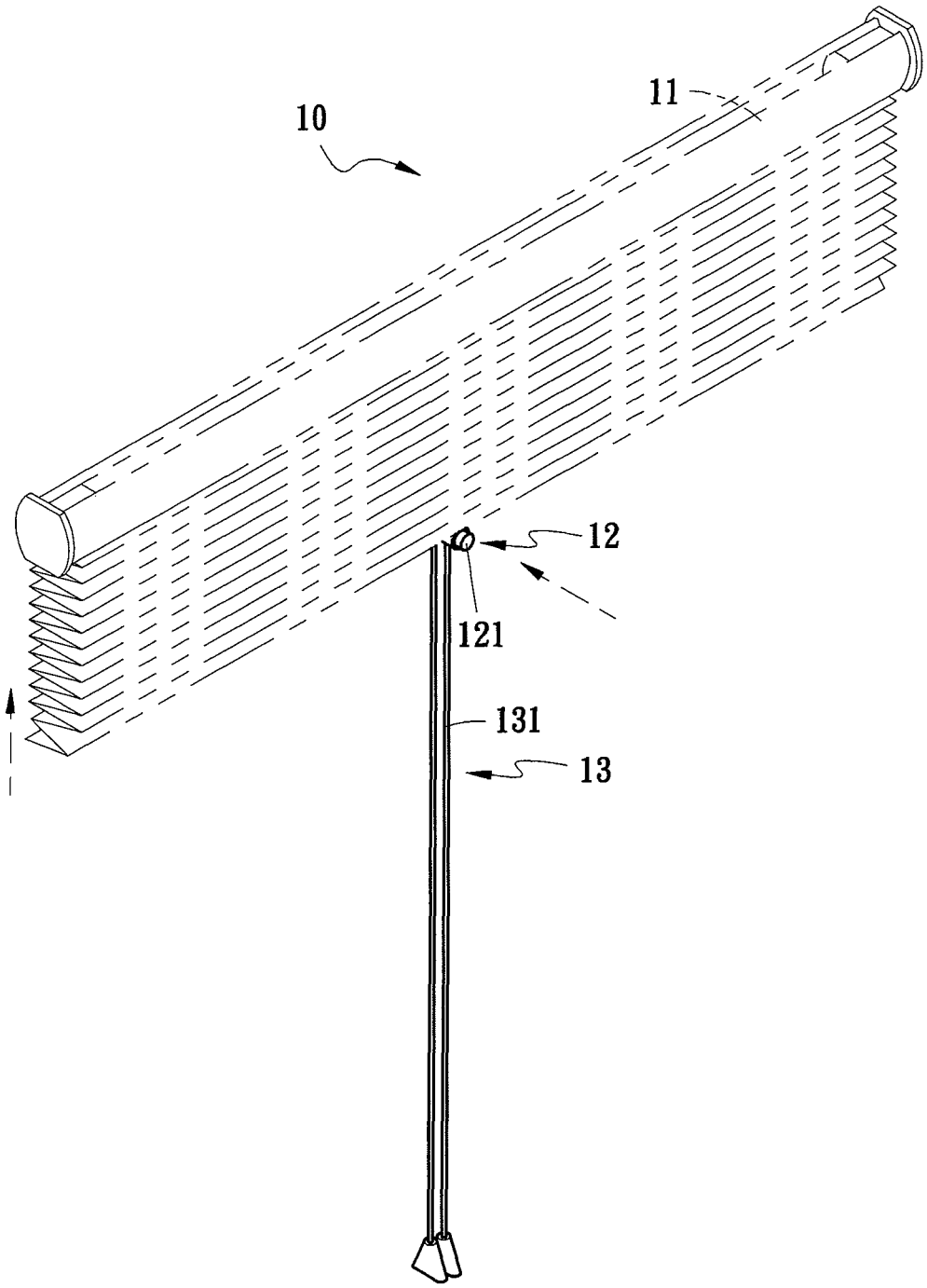
Fig . 3 PRIOR ART
FIG. 3 is a schematic view of a conventional window covering with the control switch pressed in a retracted condition.
Figure 4:
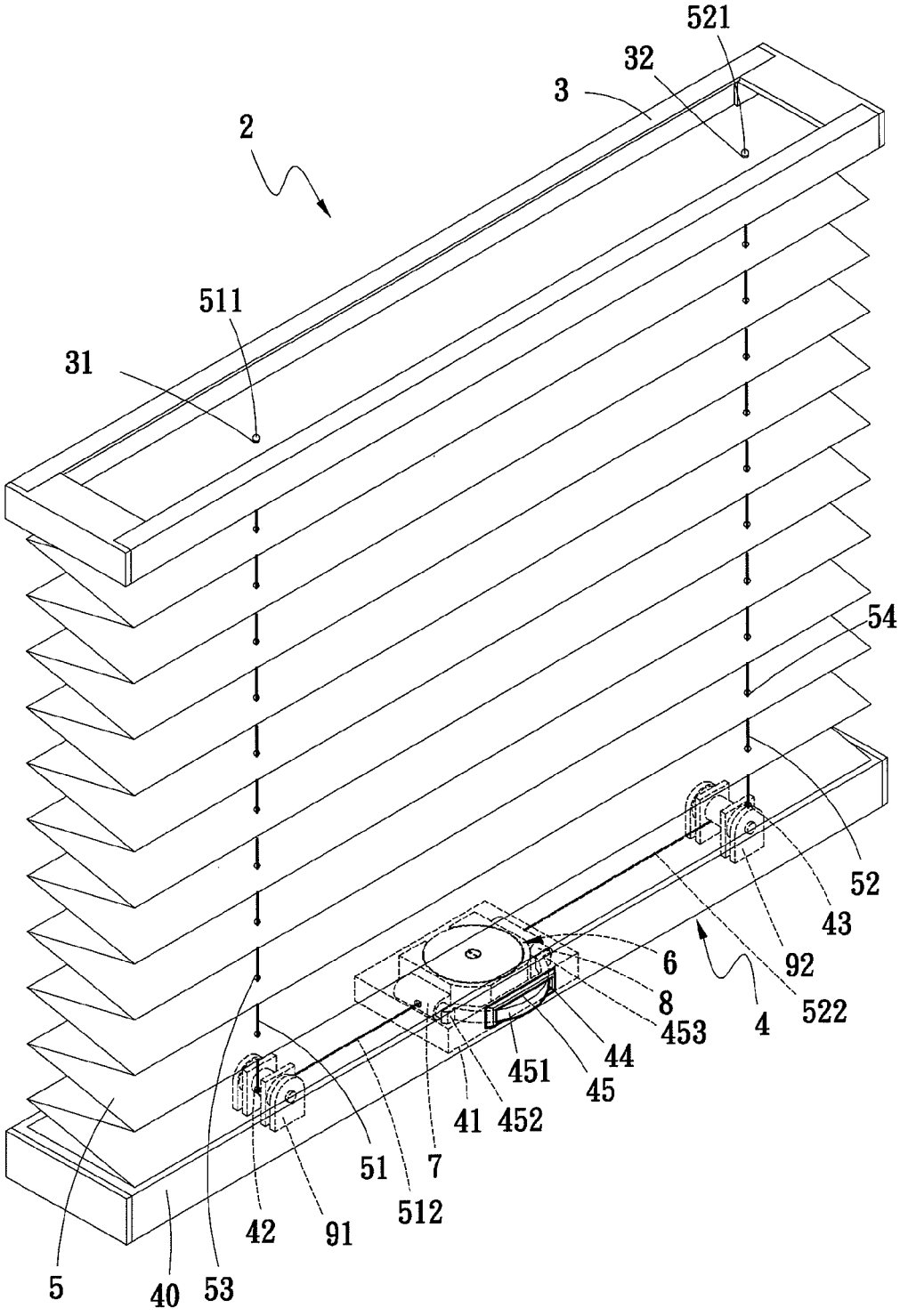
FIG. 4 is a perspective view of the invention in an extended condition.
Figure 5:
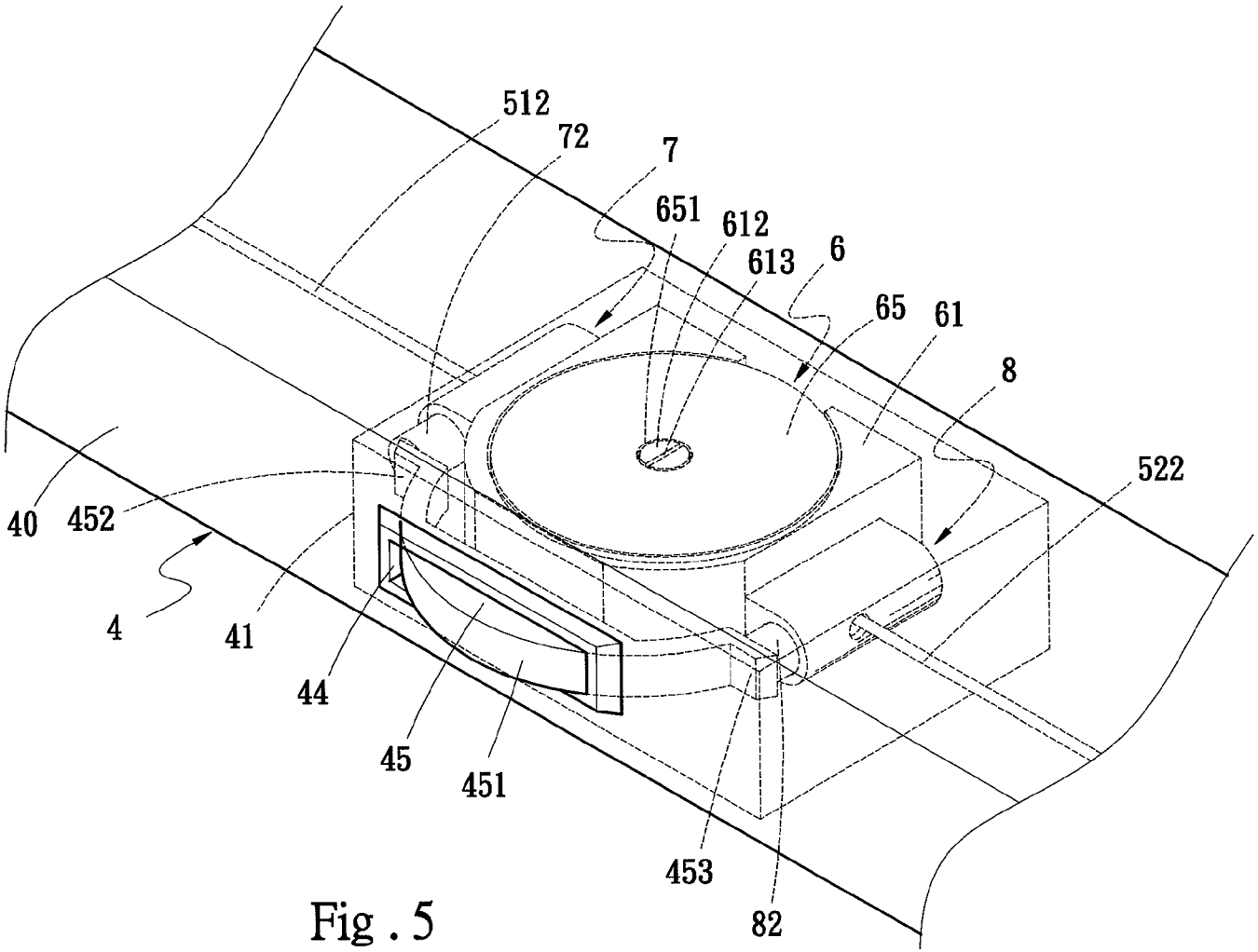
FIG. 5 is a schematic view of the invention showing that the cord winding assembly and the first and second press assemblies are located in a lower rail.
Figure 6:
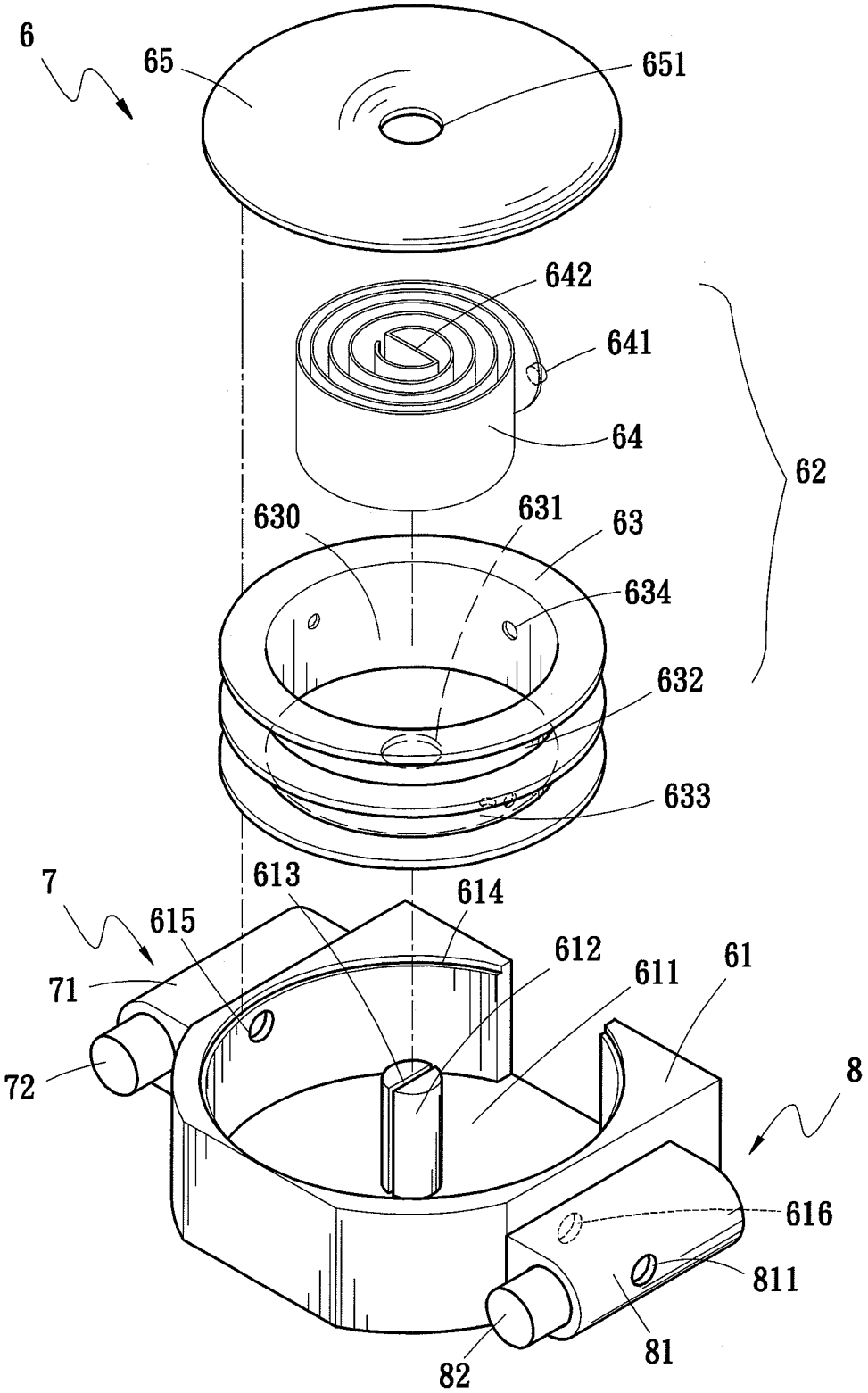
FIG. 6 is an exploded view of the cord winding assembly and the first and second press assemblies of the invention.

Please refer to FIG. 4, the present invention provides a window covering 2 which comprises:

an upper rail 3 with a first threading hole 31 and a second threading hole 32 formed thereon;

a lower rail 4 which is located below and spaced from the upper rail 3, and includes an elongate rail holder 40 with a holding trough 41 formed therein, a third threading hole 42 and a fourth threading hole 43 respectively corresponding to the first and second threading holes 31 and 32, and a slot 44 at one side of the holding trough 41;

a press member 45 which is located in the lower rail 4 and includes a press end 451 extended outwards through the slot 44. The press end 451 includes a first contact end 452 and a second contact end 453 at two sides thereof; a foldable window shade 5 which is located between the upper rail 3 and lower rail 4, and has a first cord 51 and a second cord 52, a plurality of first through holes 53 and a plurality of second through holes 54 formed thereon and respectively threaded through by the first cord 51 and second cord 52. The first end 511 of the first cord 51 and the first end 521 of the second cord 52 respectively thread through the first and second threading holes 31 and 32 to fasten to the interior of the upper rail 3, and the second end 512 of the first cord 51 and the second end 522 of the second cord 52 respectively thread through the first and second through holes 53 and 54 of the window shade 5 and the third and fourth threading holes 42 and 43 of the lower rail 4 to connect to a cord winding assembly 6;

the cord winding assembly 6, referring to FIGS. 5 and 6, which is located in the lower rail 4 corresponding to the slot 44 and includes a body 61 and a pulley set 62.

The body 61 has a first housing 611 inside, a holding strut 612 which is located in the first housing 611 and includes a slot 613, an indented rim 614 on an upper side of the first housing 611, a sealing lid 65 wedged in the indented rim 614 and having a first insertion hole 651 mating the holding strut 612, a first bore 615 on one side, and a second bore 616 on another side at an elevation lower than that of the first bore 615.

The pulley set 62 includes a winding spool 63 and a coil spring 64. The winding spool 63 includes a holding space 630 in the center, a second insertion hole 631 at the bottom run through by the holding strut 612, and an upper holding trough 632 and a lower holding trough 633 formed on the circumference thereof. The coil spring 64 is located in the holding space 630 and includes one end 641 latched on a latch slot 634 formed on an inner wall of the winding spool 63 and another end 642 latched on the slot 613 of the holding strut 612.

Figure 7:
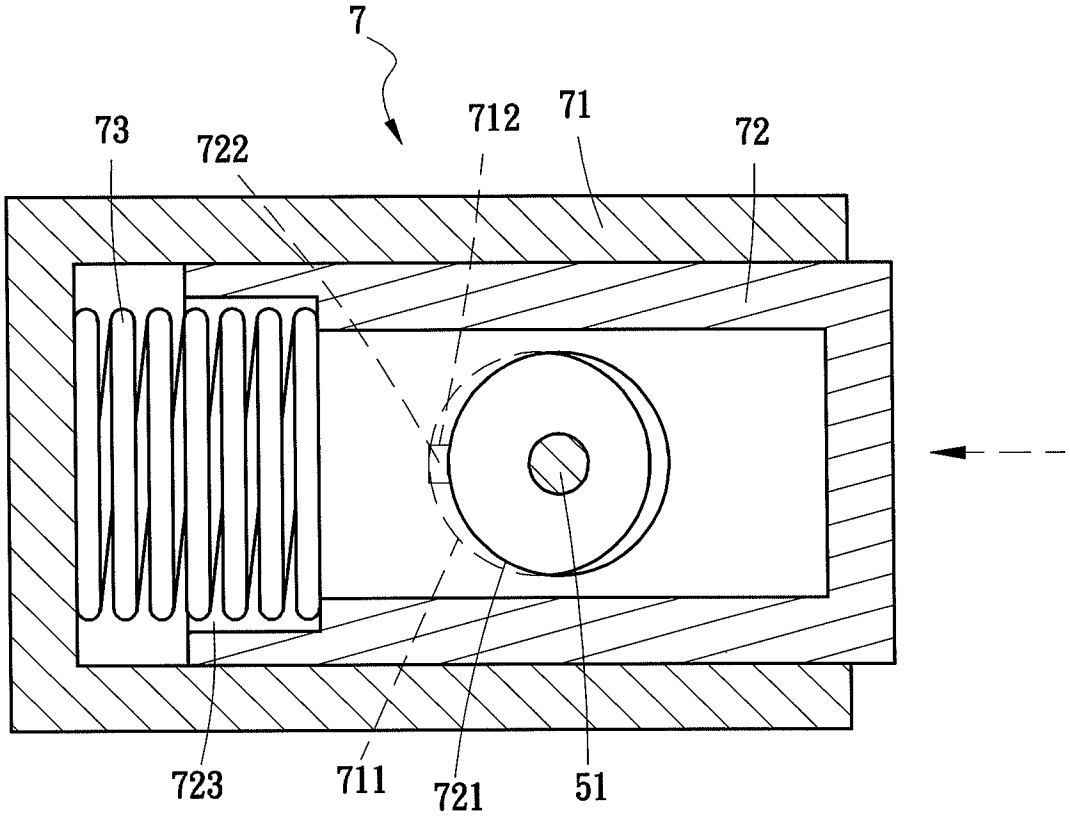
FIG. 7 is a schematic view of the first press assembly in a pressed condition.
Figure 8:
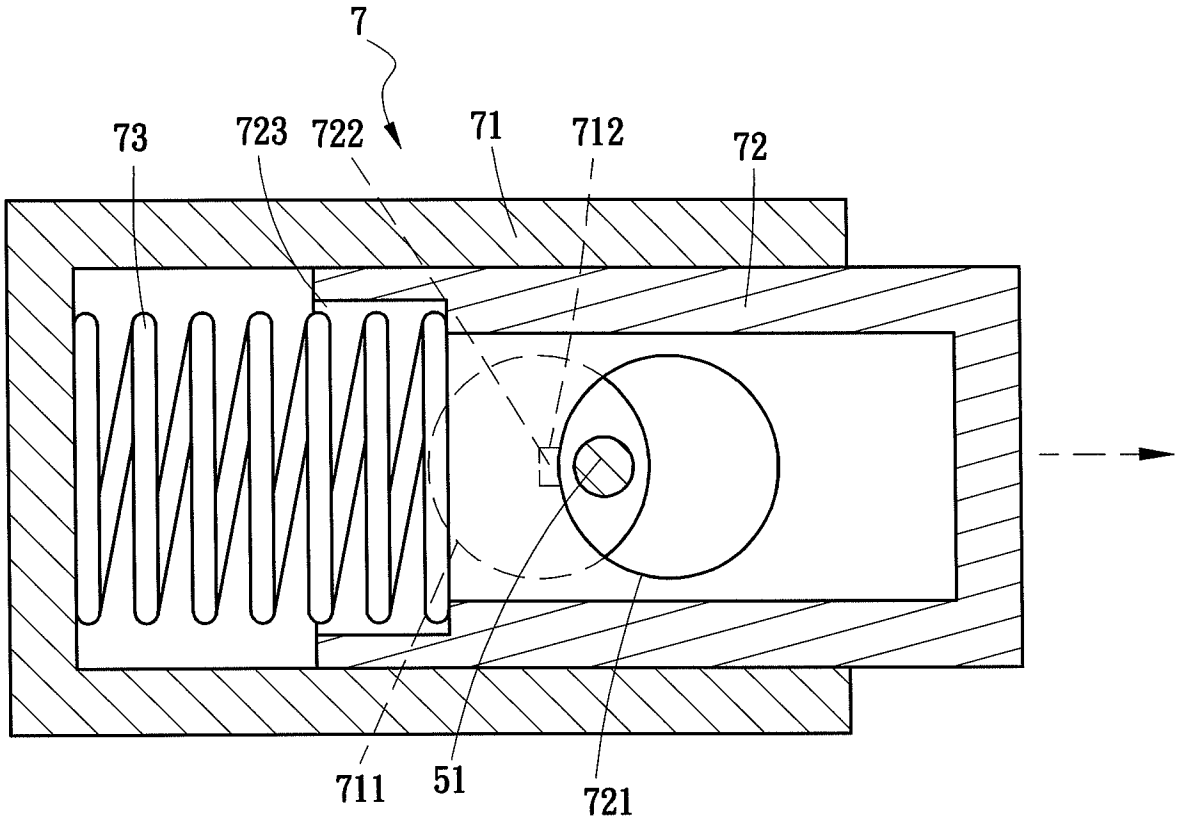
FIG. 8 is a schematic view of the first press assembly in a released condition.
Figure 9:
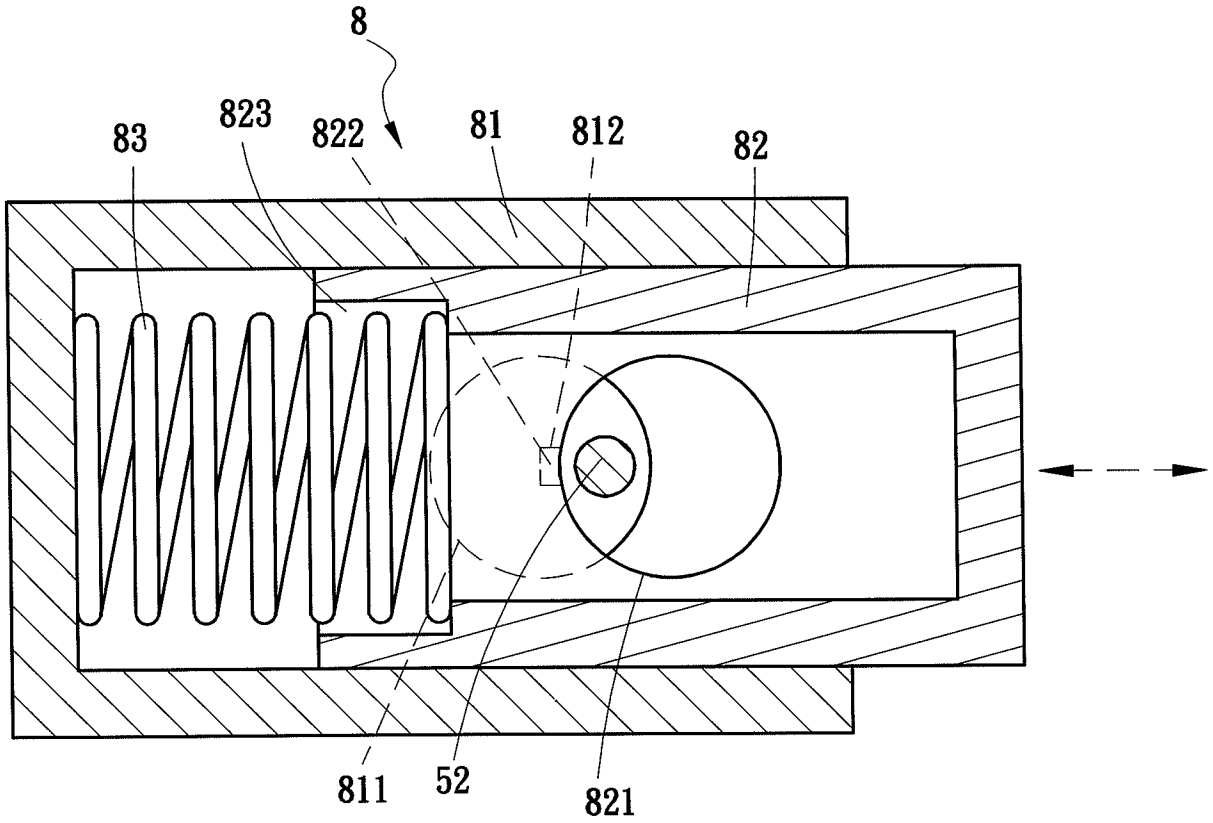
FIG. 9 is a schematic view of the second press assembly in an operating condition.

Referring to FIGS. 6 through 8, a first press assembly 7 and a second press assembly 8 are located at and connected to two sides of the cord winding assembly 6 and respectively corresponding to a first bore 615 and a second bore 616 at two sides of the body 61 with an elevation difference. The first press assembly 7 has a first hub 71 which includes two first holes 711 corresponding to the first bore 615, two corresponding first ditches 712 on an inner side, and a movable first press member 72 held inside. The first press member 72 includes an outer end contacting a first contact end 452, two first apertures 721 corresponding to the two first holes 711 of the first hub 71, and two first bosses 722 corresponding to the two first ditches 712, so that the first bosses 722 are movable in the first ditches 712 and latched thereon to prevent the first press member 72 from separating. A first elastic element 73 is held between the first hub 71 and a recess 723 of the first press member 72 to allow the first press member 72 to be pressed or released. The second press assembly 8 includes a second hub 81 which includes two second holes 811 corresponding to the second bore 616, two second ditches 812 on an inner side, and a movable second press member 82 held inside. The second press member 82 includes an outer end contacting the second contact end 453, two second apertures 821 corresponding to the two second holes 811 of the second hub 81, and two second bosses 822 corresponding to the two second ditches 812, and two second bosses 822 corresponding to the two second ditches 812, so that the two second bosses 822 are movable in the second ditches 812 and latched thereon to prevent the second press member 82 from separating. A second elastic element 83 is held between the second hub 81 and the recess 823 of the second press member 82 to allow the second press member 82 to be pressed or released (referring to FIG. 9). The first and second elastic elements 73 and 83 can be springs or other elastic elements, thereby when the first and second press members 72 and 82 are pressed, they can be movable and extensible in the first and second hubs 71 and 81, so that the first cord 51 and second cord 52 can be released or braked.

A first roller set 91 and a second roller set 92 are located inside the elongate rail holder 40 of the lower rail 4 and symmetrically positioned at two sides of the cord winding assembly 6 corresponding to the third and fourth threading holes 42 and 43 to facilitate stretching of the first and second cords 51 and 52 when winding thereon.

Please refer to FIG. 4, the second ends 512 and 522 of the first cord 51 and second cord 52 respectively thread through the third threading hole 42 and the fourth threading hole 43 of the lower rail 4, and wind respectively on the first and second roller sets 91 and 92, and then pass through respectively the two first and second holes 711 and 811 of the first and second hubs 71 and 81, and two first and second apertures 721 and 821 of the first and second press members 72 and 82, and the first bore 615 and second bore 616 of the body 61, and finally wind onto the upper holding trough 632 and lower holding trough 633 of the winding spool 63 for fastening.

Figure 10:
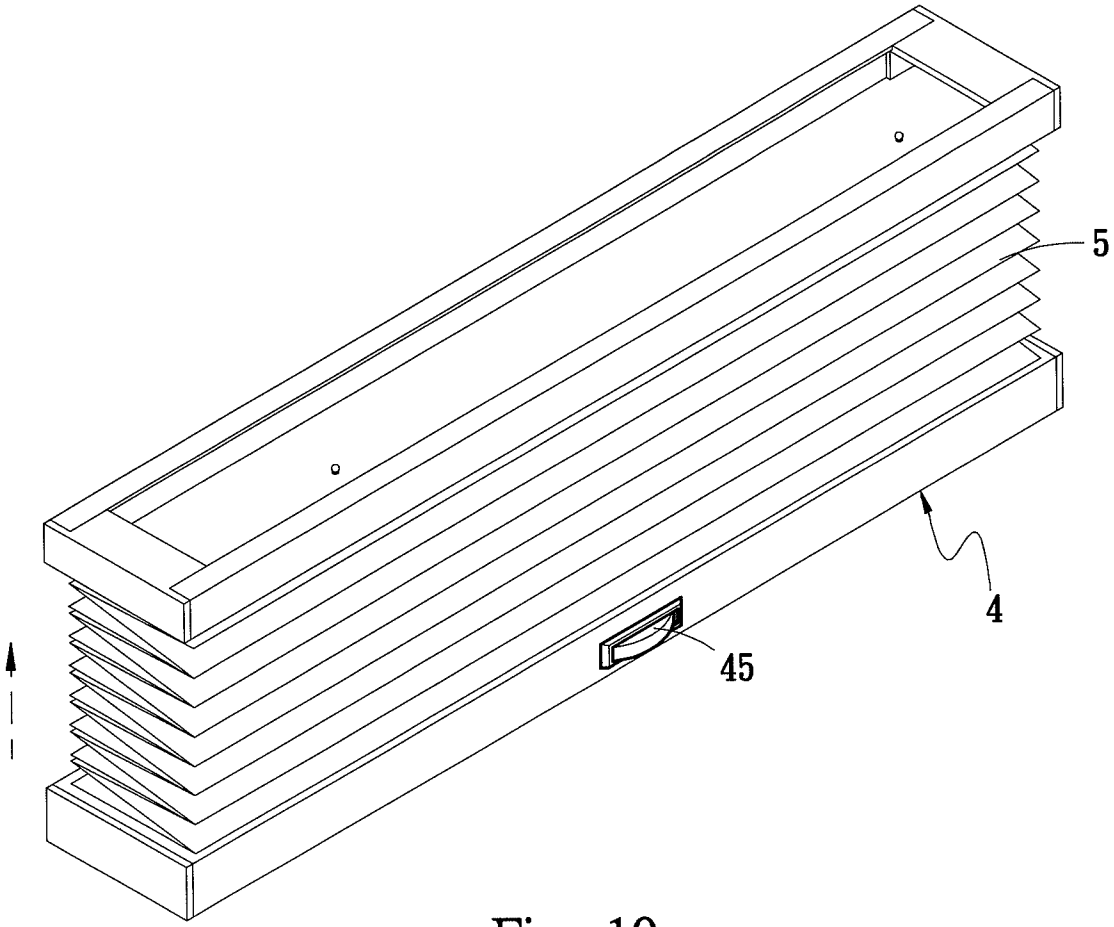
FIG. 10 is a schematic view of the invention in a retracted condition.

When retracting or extending the window covering 2 is desired, user can press the press end 451 extended outwards the lower rail 4 and pull the lower rail 4 downwards. Meanwhile, the first contact end 452 and second contact end 453 of the press member 45 respectively contact and push the first press member 72 and the second press member 82 towards the interior of the first hub 71 and second hub 81. As the first and second elastic elements 73 and 83 respectively interposed between the first press member 72 and first hub 71 and between the second press member 82 and second hub 81 are compressed, the two first holes 711 of the first hub 71 communicate with the two first apertures 721 of the first press member 72, while the two second holes 811 of the second hub 81 also communicate with the two second apertures 821 of the second press member 82, hence the first cord 51 and second cord 52 are released for drawing. The first and second cords 51 and 52 wound on the upper and lower holding troughs 632 and 633 pull the winding spool 63 to rotate, and then tighten the coil spring 64 which is latched on the latch slot 634 on the inner wall of the winding spool 63 and the slot 613 of the holding strut 612. When extending the window shade 5 for a required length is required, referring to FIGS. 8 and 9, the press member 45 is released and the first and second press members 72 and 82 return to their original positions due to the elastic forces of the first and second elastic elements 73 and 83. Then the first cord 51 and the second cord 52 are respectively clamped and held by the relative inner edges of the two first holes 711 of the first hub 71 and two first apertures 721 of the first press member 72 and the relative inner edges the two second holes 811 of the second hub 81 and two second apertures 821 of the second press member 82. Thereby the movement of the first and second cords 51 and 52 can be restricted. Therefore, when a user presses the press member 45 extended outwards from the lower rail 4 with one hand, and also holds the lower rail 4 to move upwards or downwards at the same time as shown in FIG. 10, the window shade 5 can be retracted upwards or extended downwards through the first and second cords 51 and 52 (also referring to FIG. 4). Moreover, as the first and second cords 51 and 52 are held in the cord winding assembly 6 and concealed in the lower rail 4 without exposing outside, hence the hazardous accident caused by entangling the children can be averted. The window covering also provides the functions of both sunshine blocking and decoration.

What is claimed is:

1. A window covering, comprising:

an upper rail;

a window shade which is located below the upper rail and includes a first cord and a second cord;

a lower rail which is located below the window shade and includes a first slot at one side in a middle thereof;

a press member located in the lower rail and extended outwards through the first slot;

a first press assembly and a second press assembly located in the lower rail and spaced from each other, the first press assembly and the second press assembly each including a contact surface that contacts with the press member; and a cord winding assembly which is located in the lower rail corresponding to the first slot and connected respectively to the first press assembly and the second press assembly, and includes a body and a pulley set assembled to the body, wherein the body includes a first housing inside for accommodating the pulley set, an assembling plane in the first housing, a holding strut protruding from the assembling plane and including a second slot, a first bore communicating with the first housing in correspondence with the first press assembly, and a second bore communicating with the first housing in correspondence with the second press assembly, a distance between the first bore and the assembling plane being larger than a distance between the second bore and the assembling plane, wherein the pulley set includes a winding spool coupled on the holding strut and a coil spring attached to the holding strut and the winding spool, the winding spool including a holding space formed therein for accommodating the coil spring, a second insertion hole communicating with the holding space and run through by the holding strut, an upper holding trough formed on the outer circumference thereof in correspondence with the first bore, and a lower holding trough formed on the outer circumference thereof in correspondence with the second bore and apart from the upper holding trough;

wherein the first cord includes respectively one end threading through and fastened on the upper rail and another end threading through the window shade, the interior of the lower rail, the first press assembly, the first bore, and the cord winding assembly so as to be wound around the upper holding trough, and the second cord includes respectively one end threading through and fastened on the upper rail and another end threading through the window shade, the interior of the lower rail, the second press assembly, the second bore, and the cord winding assembly so as to be wound around the lower holding trough, wherein the press member includes a semi-circular contoured press end that extends outwards through the first slot, a first contact end and a second contact end that extend ends of the press end in a direction away from each other along a direction of the lower rail, wherein the first press assembly includes a first hub which includes two first holes, two corresponding first ditches on an inner side, and a movable first press member held inside, the first press member including two first apertures corresponding to the two first holes of the first hub and two first bosses corresponding to the two first ditches, the first hub and the first press member being interposed by a first elastic element, wherein the second press assembly includes a second hub which includes two second holes, two corresponding second ditches on an inner side, and a movable second press member held inside, the second press member including two second apertures corresponding to the two second holes of the second hub and two second bosses corresponding to the two second ditches, the second hub and the second press member being interposed by a second elastic element, and wherein the contact surfaces of the first press assembly and the second press assembly are formed on the first press member and the second press member respectively, and the first contact and the second contact end contact and press the contact surfaces of press assembly and the second press assembly, respectively.

2. The window covering of claim 1, wherein the body includes an indented rim on an upper side of the first housing, and a sealing lid wedged in the indented rim, and the coil spring is located in the holding space and includes one end latched on a latch slot formed on an inner wall of the winding spool and another end latched on the second slot of the holding strut.

3. The window covering of claim 1, wherein the upper rail includes a first threading hole and a second threading hole running through a bottom thereof and threaded through by the first cord and the second cord respectively for fastening on the upper rail.

4. The window covering of claim 3, wherein the lower rail includes a third threading hole and a fourth threading hole respectively corresponding to the first threading hole and the second threading hole and threaded through by the first cord and the second cord.

5. The window covering of claim 4, wherein the lower rail includes a first roller set and a second roller set located inside symmetrically at two sides of the cord winding assembly and corresponding to the third threading hole and the fourth threading hole to be wound by the first cord and the second cord respectively.

* * * * *